US010428451B2

(12) United States Patent
Seo et al.

(10) Patent No.: US 10,428,451 B2
(45) Date of Patent: Oct. 1, 2019

(54) WASHING MACHINE WITH WATER SUPPLY DISTRIBUTOR

(71) Applicant: LG ELECTRONICS INC., Seoul (KR)

(72) Inventors: Bo Sung Seo, Seoul (KR); Jin Ho Kim, Seoul (KR); Soo Young Oh, Seoul (KR); Chang Oh Kim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 227 days.

(21) Appl. No.: 14/898,009

(22) PCT Filed: Jun. 11, 2014

(86) PCT No.: PCT/KR2014/005135
§ 371 (c)(1),
(2) Date: Dec. 11, 2015

(87) PCT Pub. No.: WO2014/200269
PCT Pub. Date: Dec. 18, 2014

(65) Prior Publication Data

US 2016/0122935 A1 May 5, 2016

(30) Foreign Application Priority Data

Jun. 14, 2013 (KR) ..... 10-2013-0068562

(51) Int. Cl.
*D06F 39/08* (2006.01)
*A47L 15/42* (2006.01)

(52) U.S. Cl.
CPC ..... *D06F 39/088* (2013.01); *D06F 39/08* (2013.01); *D06F 39/087* (2013.01); *A47L 15/4221* (2013.01)

(58) Field of Classification Search
CPC ... A47L 15/4221; D06F 39/08; D06F 39/087; D06F 39/088
See application file for complete search history.

(56) References Cited

U.S. PATENT DOCUMENTS

2007/0067920 A1* 3/2007 Zaccone ..... D06F 25/00 8/158
2012/0090360 A1* 4/2012 Nolan ..... D06F 23/04 68/12.19

(Continued)

FOREIGN PATENT DOCUMENTS

DE 102007056922 A1 5/2009
EP 2559370 A1 2/2013

(Continued)

*Primary Examiner* — Spencer E Bell
(74) *Attorney, Agent, or Firm* — Dentons US LLP

(57) ABSTRACT

The present invention relates to a washing machine. A washing machine according to an embodiment of the present invention comprises: a casing for forming the exterior; a tub arranged inside the casing; a drum rotatably provided in the tub to contain laundry; and a water supply/distribution device arranged inside the casing, the water supply/distribution device having a temporary space, in which water flowing in from the outside gathers, a plurality of discharge ports for distributing the water in the temporary space towards a plurality of locations, and a pressure limiting unit for limiting the rise of water pressure in the temporary space.

15 Claims, 8 Drawing Sheets

(56) References Cited

U.S. PATENT DOCUMENTS

| | | | | |
|---|---|---|---|---|
| 2012/0318389 | A1* | 12/2012 | Holstein | A47L 15/4221 137/625 |
| 2013/0000762 | A1* | 1/2013 | Buddharaju | A47L 15/4221 137/605 |
| 2013/0086754 | A1* | 4/2013 | Hendrickson | D06F 39/003 8/137 |

FOREIGN PATENT DOCUMENTS

| | | | |
|---|---|---|---|
| JP | 07-289782 | A | 11/1995 |
| KR | 20-1998-0044241 | U | 9/1998 |
| KR | 10-1999-0020956 | A | 3/1999 |
| KR | 10-2005-0099173 | A | 10/2005 |
| KR | 20050099173 | A | 10/2005 |
| KR | 10-2006-0023017 | A | 3/2006 |
| KR | 10-2010-0034927 | A | 4/2010 |
| KR | 20100034927 | A | 4/2010 |

* cited by examiner

WASHING MACHINE WITH WATER SUPPLY DISTRIBUTOR

This application is a National Stage Entry of International Application No. PCT/KR2014/005135, filed on Jun. 11, 2014, and claims the benefit of and priority to Korean Patent Application No. 10-2013-0068562, filed on Jun. 14, 2013, each of which are hereby incorporated by reference in their entirety for all purposes as if fully set forth herein.

TECHNICAL FIELD

The present invention relates to a washing machine and, more particularly, to a water supply distributor for distributing water introduced into a washing machine.

BACKGROUND ART

In general, a washing machine commonly refers to an apparatus for separating pollutants attached to clothes, bedclothes, etc. (hereinafter abbreviated as 'laundry') using a chemical decomposition action of water and a detergent and friction between water and the laundry. Such a washing machine has a basic structure in which a drum for accommodating the laundry is rotatably installed. Meanwhile, the washing machine changes water in various conditions, such as hot water, cold water, and steam, depending on a washing cycle in order to improve washing efficiency. Furthermore, a detergent, a bleaching agent, a rinse agent, etc. are divided and stored in a detergent box. Accordingly, a plurality of water supply pipes for moving water to required places is present in the washing machine.

If a plurality of valves is used as in a prior art, however, there is a problem in that the construction becomes complicated. Furthermore, if a Y-shaped pipe is used to move water to a plurality of directions, there is a problem in that durability of the pipe is reduced.

DISCLOSURE

Technical Problem

An object of the present invention is to move water to a plurality of pipes at the same time even without using a Y-shaped pipe.

Another object of the present invention is to supply water to a plurality of points at the same time using a single water supply distributor.

Yet another object of the present invention is to limit internal pressure in order to prevent damage when an abnormal operation, such as that all the discharge flow channels of a water supply distributor are closed, is generated.

Objects of the present invention are not limited to the aforementioned objects, and those skilled in the art may evidently understand other objects that have not been mentioned above from the following description.

Technical Solution

To achieve the above objects, a washing machine according to an embodiment of the present invention includes a casing forming an exterior; a tub disposed within the casing; a drum rotatably provided in the tub, for accommodating the laundry; and a water supply distributor disposed within the casing and including a temporary space in which externally introduced water gathers, a plurality of discharge ports for distributing the water of the temporary space toward a plurality of points, and a pressure limit unit for limiting an increase of water pressure within the temporary space.

The water supply distributor includes a flow channel switching plate of a disk shape in which an open hole is formed; and a housing into which the flow channel switching plate is rotatably inserted and in which a flow channel for communicating the open hole with the discharge ports is formed when the flow channel switching plate is rotated.

The housing includes a rim portion surrounding the side of the flow channel switching plate and forming the sidewall of the temporary space and a flow channel forming plate in which the rim portion stands upright and a plurality of discharge holes is formed so that the flow channel communicates with the open hole. The pressure limit unit is formed to discharge the water gathered in the temporary space when the flow channel switching plate is disposed so that the open hole and the discharge holes do not communicate with each other.

The flow channel switching plate includes a plurality of through holes arranged to form a circle around the center of rotation. The pressure limit unit includes a space formed in the housing, for communicating with the through holes so that the water is introduced through the through holes.

The pressure limit unit is formed in a gear form so that whether the pressure limit unit communicates with the temporary space is different depending on a rotation angle of the flow channel switching plate.

The pressure limit unit forms inlet spaces periodically formed to communicate with the through holes and a water collection space of a circle so that the inlet spaces are interconnected.

The through holes and the discharge holes are periodically formed at an identical angle around the center of rotation so that each of the through and discharge holes forms a circle. An angle cycle formed by the through holes is the same as an angle cycle formed by the discharge holes.

The pressure limit unit communicates with the discharge holes so that the water introduced through the through holes flows into the discharge ports.

The discharge holes include a plurality of first discharge holes arranged to form a circle around the center of rotation of the flow channel switching plate and a second discharge hole formed closer to the center of rotation than to the first discharge holes, for communicating with at least any one of the first discharge holes.

The flow channel switching plate includes a first open hole selectively communicating with at least any one of the first discharge holes depending on a rotation angle, a second open hole communicating with the second discharge hole depending on a rotation angle, and through holes formed closer to the center of rotation than to the second open hole. The pressure limit unit includes a space formed within the flow channel forming plate so that the through holes and the second discharge hole are coupled when the first discharge holes and the second discharge hole are closed by the flow channel switching plate.

The washing machine further includes a cap covering the housing in such a way as to form the temporary space; an inlet port formed in the cap, for communicating with the temporary space so that the water is supplied to the water supply distributor; and a flow channel switching motor disposed on one surface of the cap, for rotating the flow channel switching plate.

The housing includes mounting surfaces which are formed under the rim portion and which are orthogonal to each other so that the discharge port is protruded. At least part of the cap is rounded and mounted on the rim portion. The inlet port is formed over a portion in which the mounting surfaces are met.

The washing machine further includes a cap covering the housing to form the temporary space. The pressure limit unit includes a protruding portion communicating with the temporary space and lengthily extended to an outside of the housing or the cap; a shield plate inserted into the protruding portion in such a way as to shield a flow channel formed within the protruding portion; a resilient member disposed between an end of the protruding portion and the shield plate; and a pressure release port communicating with the protruding portion so that water is discharged to the outside when the shield plate is moved by the water pressure of the temporary space.

The washing machine further includes an inlet port formed in the housing, for communicating with the temporary space so that the water is supplied to the water supply distributor; and a flow channel switching motor mounted on the housing, for rotating the flow channel switching plate.

Mounting surfaces orthogonal to each other are formed on the side of the housing so that the discharge port is protruded. The inlet port is formed in a portion in which the mounting surfaces are met.

The washing machine further includes a flowmeter mounted on the inlet port, for measuring a rate of flow of water flowing into the inlet port.

The housing includes a first mounting surface flatly formed on the side of the housing, a second mounting surface meeting the first mounting surface at a right angle, extended from the first mounting surface, and curved toward the side end portion of the second mounting surface, a third mounting surface meeting the second mounting surface in such a way as to be curved, extended from the second mounting surface, and flatly formed toward the side end portion of the third mounting surface, and a fourth mounting surface meeting the third mounting surface at a right angle, flatly formed, and forming a right angle with the first mounting surface. The discharge port is formed in at least two of the first mounting surface, the second mounting surface, the third mounting surface, and the fourth mounting surface.

A washing machine according to an embodiment of the present invention includes a casing forming an exterior; a tub disposed within the casing; a drum rotatably provided in the tub, for accommodating a laundry; and a water supply distributor disposed within the casing, for distributing externally introduced water to a plurality of points. The water supply distributor includes a housing in which a pressure limit unit recessed in a gear form and discharge holes formed in a cycle of a constant angle around the pressure limit unit are formed; and a flow channel switching plate rotatably inserted into the housing and including a plurality of holes alternately communicating with the pressure limit unit or the discharge holes depending on a degree of rotation.

The plurality of holes includes an open hole communicating with the discharge holes depending on a degree of rotation of the flow channel switching plate and through holes capable of communicating with the pressure limit unit depending on a degree of rotation of the flow channel switching plate. The open hole and the through holes are placed at different distances from the center of rotation of the flow channel switching plate.

A washing machine according to an embodiment of the present invention includes a drum accommodating fabrics; a tub accommodating the drum; and a water supply distributor including a plurality of discharge ports for supplying externally supplied water to a plurality of target points including the tub and a pressure limit unit for limiting an increase of internal pressure if water is not discharged by any part of the plurality of discharge ports. When the water supply distributor operates to supply the water to at least any one of the plurality of target points, the water supply distributor communicates a flow channel alternately with at least any one of the plurality of discharge ports and the pressure limit unit.

The details of other embodiments are included in the detailed description and drawings.

Advantageous Effects

The present invention has one or more of the following advantages.

First, there is an advantage in that water can be supplied to a plurality of points even without using a Y-shaped pipe.

Second, there is an advantage in that the construction of the water supply distributor becomes simple and is reduced in volume.

Third, pressure within the water supply distributor can be maintained at specific pressure or lower.

Advantages of the present invention are not limited to the aforementioned advantages, and those skilled in the art may evidently understand other advantages that have not been mentioned above from the following description.

MODE FOR INVENTION

The merits and characteristics of the present invention and a method for achieving the merits and characteristics will become apparent from embodiments described in detail with reference to the accompanying drawings. However, the present invention is not limited to the disclosed embodiments, but may be implemented in various other forms. The present embodiments are only provided to complete the disclosure of the present invention and to allow those skilled in the art to which the present invention pertains to fully understand the category of the present invention. The present invention is defined by the category of the claims. The same reference numbers are used to refer to the same or similar parts throughout the drawings.

The present invention is described with reference to the drawings for describing a washing machine in connection with the embodiments of the present invention.

Figure 1:
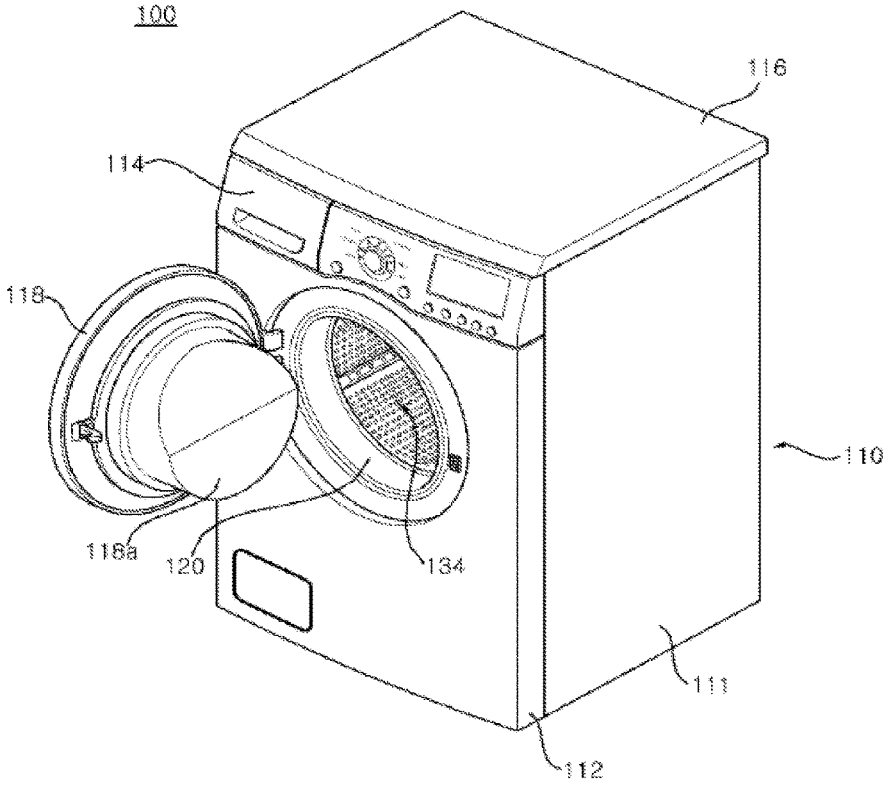
FIG. 1 is a perspective view showing a washing machine according to an embodiment of the present invention.
Figure 2:
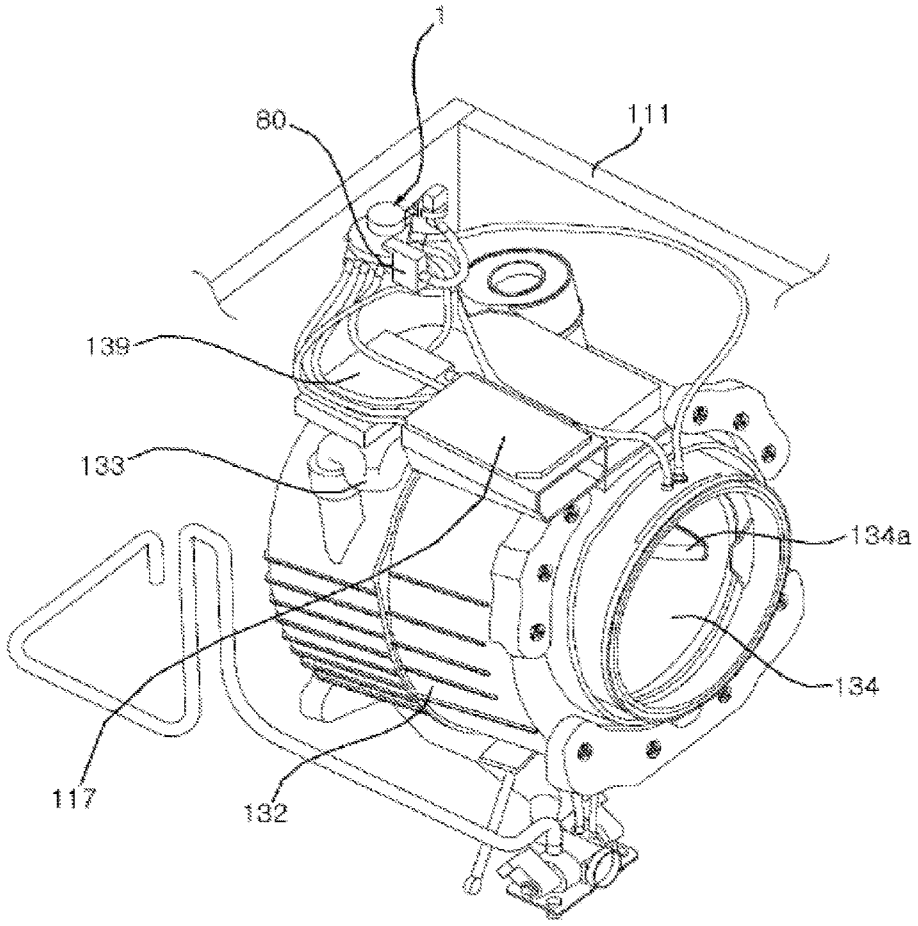
FIG. 2 is a perspective view showing the inside of the washing machine according to an embodiment of the present invention.
Figure 3:
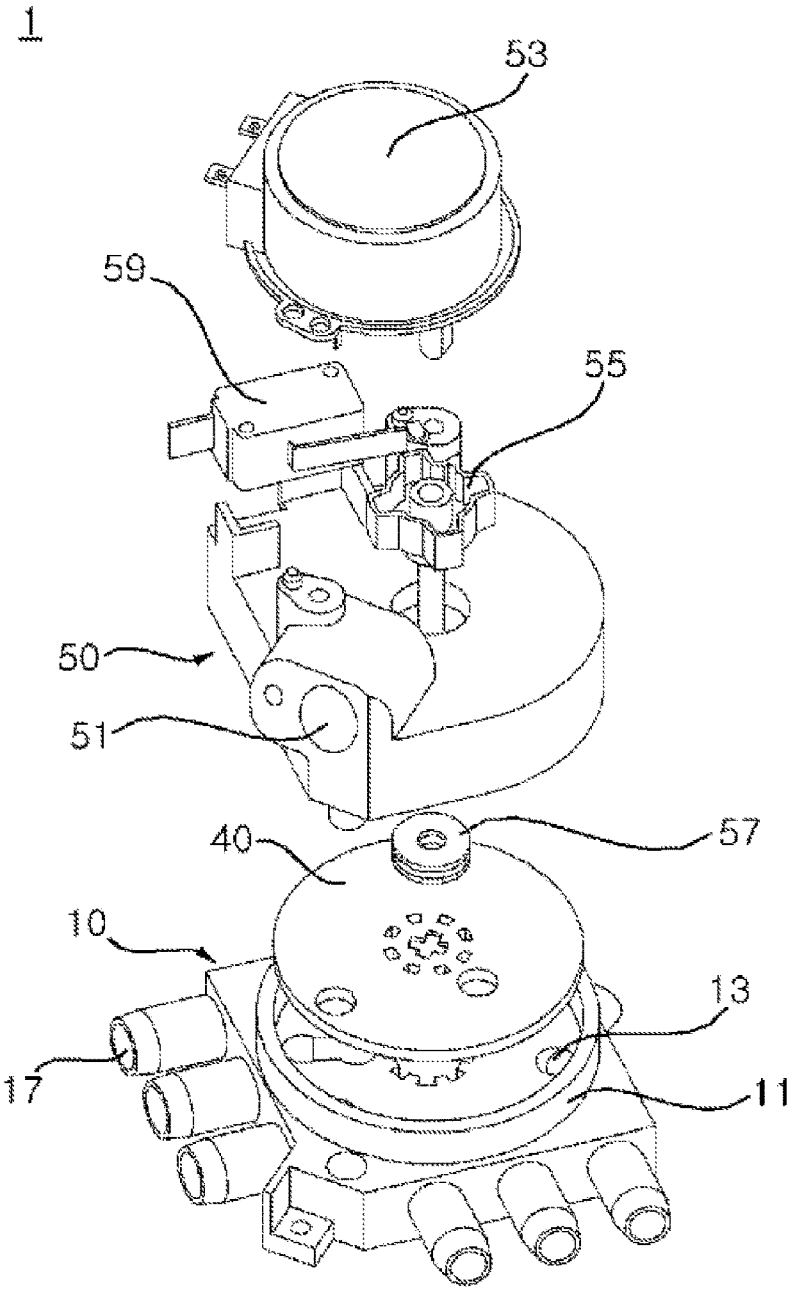
FIG. 3 is an exploded perspective view showing a water supply distributor according to an embodiment of the present invention.

FIG. 1 is a perspective view showing a washing machine 100 according to an embodiment of the present invention, FIG. 2 is a perspective view showing the inside of the washing machine 100 according to an embodiment of the present invention, and FIG. 3 is an exploded perspective view showing a water supply distributor 1 according to an embodiment of the present invention.

Referring to FIGS. 1 to 3, the washing machine 100 according to an embodiment of the present invention includes a casing 110 forming an exterior; a tub 132 disposed within the casing 110; a drum 134 rotatably provided in the tub 132 and accommodating the laundry; and a water supply distributor 1 disposed within the casing 110 and including a temporary space S in which externally introduced water gathers, a plurality of discharge ports 17 for distributing the water of the temporary space S toward a plurality of points, and a pressure limit unit 30 for limiting an increase of water pressure within the temporary space S. The casing 110 forms the exterior of the washing machine 100. The tub 132 in which water is contained is clung to the casing 110. The drum 134 in which the laundry is accommodated is provided within the tub 132. The casing 110 may further include a heater for heating water contained in the tub 132.

The casing 110 may include a cabinet 111 forming the exterior of the washing machine 100 and having a front surface and a top surface opened, a base supporting the cabinet 111, a front cover 112 having a laundry entrance hole formed therein so that the laundry enters the laundry entrance hole and coupled to the front surface of the cabinet 111, and a top cover provided on top of the cabinet 111. A door 118 for opening and closing the laundry entrance hole may be rotatably provided in the front cover 112.

Glass 118*a* may be provided in the door 118 so that the laundry within the drum 134 can be seen. The glass 118*a* may be formed in a convex shape, and the front end of the glass 118*a* may be protruded into the drum 134 in the state in which the door 118 has been closed.

The detergent box 114 contains additives, such as a detergent for preliminary or actual washing, a fabric softener, and a bleaching agent, and is provided in the casing 110 in such a way as to be drawn.

The tub 132 may clung to the top cover by a spring so that vibration generated when the drum 134 rotates can be reduced. A damper supporting the tub 132 on the lower side thereof may be further included in the tube 132.

A plurality of holes is formed in the drum 134 so that water can flow between the tub 132 and the drum 134. One or more lifters 134*a* may be provided along the inner circumferential surface of the drum 134 so that the laundry is lifted up and then drops when the drum 134 is rotated. The drum 134 is not disposed completely horizontally, but may be disposed at a predetermined slope so that the rear portion of the drum 134 is placed on the lower side than horizontality.

A motor providing a driving force for rotating the drum 134 may be provided. There are a direct driving method and an indirect driving method depending on a method of transferring the driving force provided by the motor to the drum 134. In the direct driving method, the pivot of the motor is directly coupled to the drum 134, and the pivot of the motor and the center of the drum 134 are aligned on the same line. The washing machine 100 according to the present embodiment complies with such a direct driving method. The drum 134 is rotated by the motor provided in the space between the rear of the tub 132 and the cabinet 111, but the present invention is not necessarily limited thereto. The indirect driving method may also be applied to the present invention.

In the indirect driving method, the drum 134 is rotated using power transfer means, such as a belt or pulley for transferring the driving force provided by the motor. The pivot of the motor and the center of the drum 134 need not to be necessarily aligned on the same axis.

A gasket 120 is provided between the cabinet 111 and the tub 132. The gasket 120 has one side coupled to the cabinet 111 and the other side coupled to the circumference of the open front surface portion of the tub 132. Accordingly, water contained in the tub 132 is prevented from leaking between the tub 132 and the cabinet 111. Furthermore, the gasket 120 is resiliently hinged in response to the vibration of the tub 132, thus functioning to reduce vibration. The gasket 120 may be made of a deformable or flexible material having some elastic force and may be formed using natural rubber or synthetic resin.

In the washing machine 100, water introduced from an external water supply source is supplied to the detergent box 114, a steam generation device 139 and/or a whirl nozzle and/or a steam nozzle through proper control of the water supply distributor 1. The detergent box 114 is received into a detergent box housing 117. The detergent box housing 117 communicates with the tub 132 through a water supply bellows 133. After water supplied by a water supply unit is mixed with the additives via the detergent box 114, the water flow into the tub 132 along the water supply bellows 133 connected to the detergent box housing 117. The additives contained in the detergent box 114 may include a detergent, a fabric softener, a bleaching agent, etc., for example. A plurality of partitioned accommodation spaces may be provided in the detergent box 114 so that the additives are not mixed and are separated and contained in the spaces.

The water supply distributor 1 includes an inlet port 51 to which external water is inputted and the discharge port 17 from which water is discharged. A plurality of the discharge ports 17 is provided and coupled to water supply hoses 131, respectively. The water supply distributor 1 is connected to the plurality of water supply hoses 131. The plurality of water supply hoses may be classified depending on their use or connection relationships. The water supply hoses 131 may be classified depending on a temperature of flowing water, may be classified depending on whether each hose is connected to what one of the partitioned spaces of the detergent box 114, and may be classified depending on whether a hose is connected to the steam generation device 139, a spray nozzle, etc.

For example, some of the plurality of water supply hoses may be used to supply water to the detergent box 114, and the hoses are connected in accordance with the respective partitioned spaces formed within the detergent box 114 in order to separate and contain the additives by type. Furthermore, the water supply distributor 1 may be controlled so that it moves water to two or more water supply hoses at the same time.

The steam generation device 139 is a device for generating steam by heating water. Some of the plurality of water supply hoses 131 are connected to the steam generation device 139. Steam generated by the steam generation device 139 is supplied to the steam nozzle through a steam supply hose.

A housing 10 may form part of the exterior of the water supply distributor 1. A flow channel switching plate 40 may be mounted on the inside of the housing 10. The flow channel switching plate 40 is rotated so that introduced water can flow into at least one of the plurality of discharge ports 17.

If the operation of the flow channel switching plate 40 is stopped in the state in which flow channels have not been connected while the flow channel switching plate 40 operates, pressure within the water supply distributor 1 is increased because water is unable to be discharged. In the present invention, the pressure limit unit 30 is formed in order to prevent damage to the water supply distributor 1 attributable to an increase of water pressure.

Figure 4:
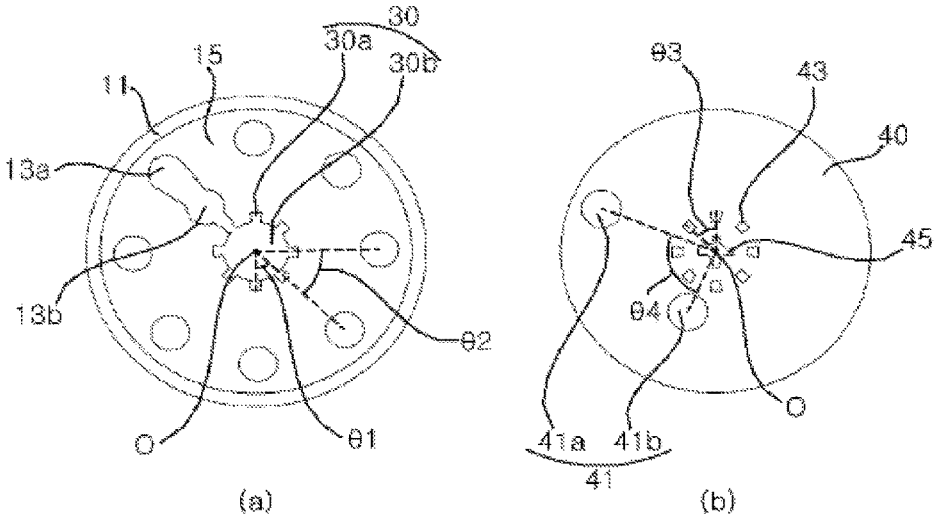
FIG. 4 is a plan view showing a flow channel forming plate and a flow channel switching plate according to an embodiment of the present invention.
Figure 5:
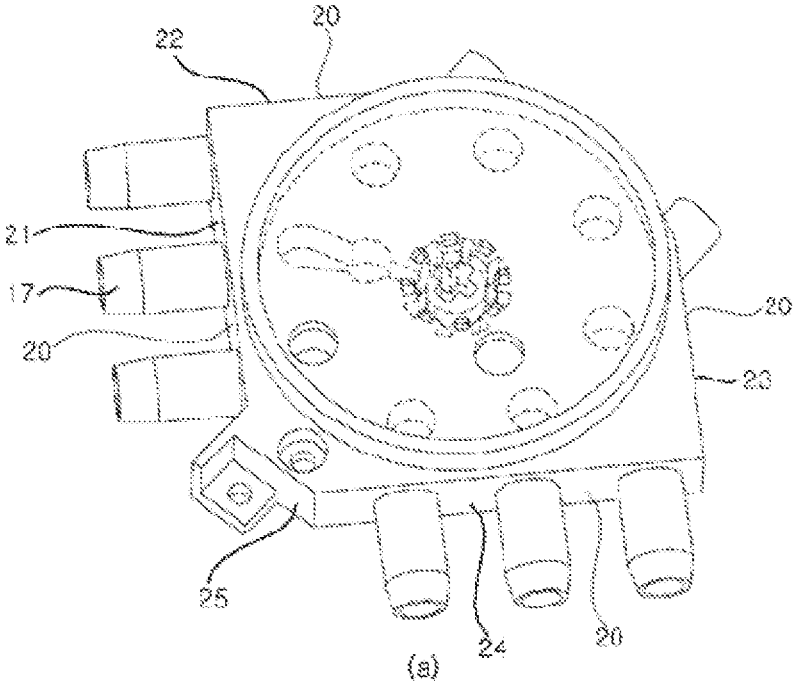
FIG. 5 shows a case where a pressure limit unit according to an embodiment of the present invention operates.
Figure 5:
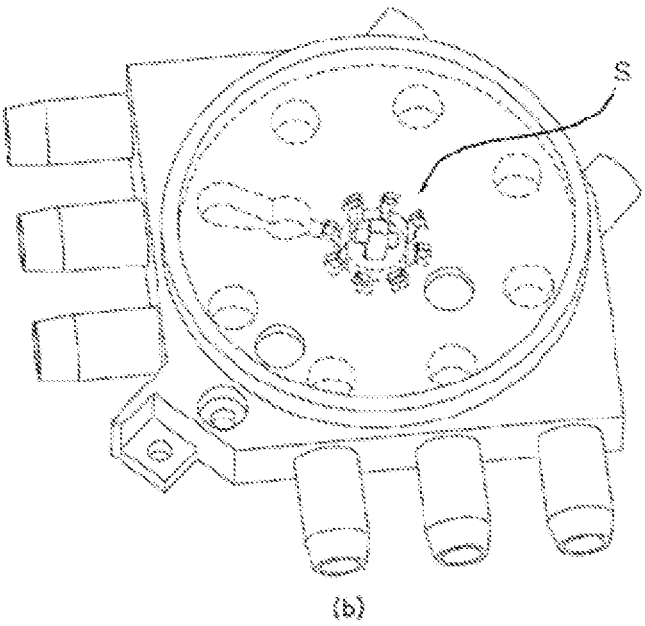
Figure 6:
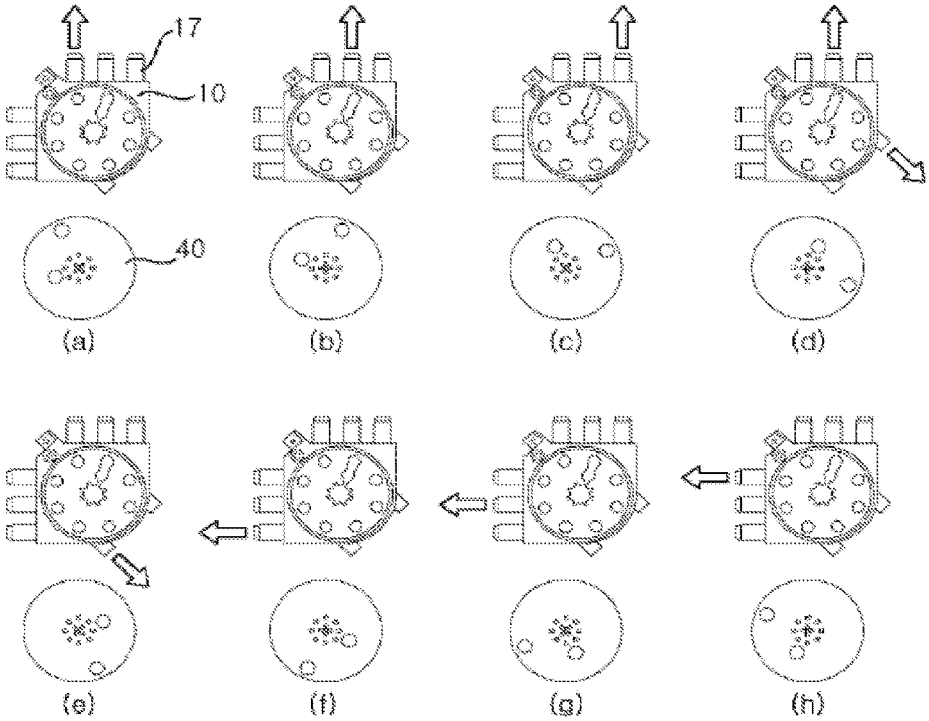
FIG. 6 shows the distribution of water according to the operation of the flow channel switching plate according to an embodiment of the present invention.

FIG. 4 is a plan view showing a flow channel forming plate 15 and a flow channel switching plate 40 according to an embodiment of the present invention, FIG. 5 shows a case where the pressure limit unit 30 according to an embodiment of the present invention operates, and FIG. 6 shows the distribution of water according to the operation of the flow channel switching plate 40 according to an embodiment of the present invention.

Referring to FIGS. 4 to 6, a first mounting surface 21 flatly formed on the side of the housing 10, a second mounting surface 22 meeting the first mounting surface 21 at a right angle, extended from the first mounting surface 21, and curved toward the side end portion of the second mounting surface, a third mounting surface 23 meeting the second mounting surface 22 in such a way as to be curved, extended from the second mounting surface 22, and flatly formed toward the side end portion of the third mounting surface, and a fourth mounting surface 24 meeting the third mounting surface 23 at a right angle, flatly formed, and forming a right angle with the first mounting surface 21 are formed in the housing 10 according to an embodiment of the present invention. The discharge port 17 may be formed in at least two of the first mounting surface 21, the second mounting surface 22, the third mounting surface 23, and the fourth mounting surface 24.

For example, the three discharge ports 17 may be formed in each of the first mounting surface 21 and the fourth mounting surface 24. Furthermore, the single discharge port 17 may be formed in each of the second mounting surface 22 and the third mounting surface 23. If the water supply distributor 1 is formed as described above, a total of the eight discharge ports 17 may be formed. Meanwhile, a middle surface 25 that is formed relatively flatly may be formed between the first mounting surface 21 and the fourth mounting surface 24. In some embodiments, the inlet port 51 may be formed in the middle surface 25.

The washing machine according to an embodiment of the present invention include the inlet port 51 formed in a cap 50 and communicating with the temporary space S so that water is supplied to the water supply distributor 1; and a flow channel switching motor 53 disposed on one surface of the cap 50 in such a way as to rotate the flow channel switching plate 40.

The inlet port 51 may be formed in the cap 50 or the housing 10. If the inlet port 51 is formed in the cap 50, the inlet port 51 may be formed on the upper side of the middle surface 25. A flowmeter 80 to be described later may be mounted in front of the inlet port 51. Since a specific space is required to dispose the flowmeter 80, the influence of the discharge port 17 on the flowmeter 80 can be minimized through such a disposition.

The flow channel switching motor 53 may be disposed on one surface of the cap 50 or may be disposed on one surface of the housing 10. The pivot of the flow channel switching motor 53 is connected to a cam 55. The cam 55 is inserted into a cam insertion hole 45 formed in the flow channel switching plate 40. A sealer 57 for preventing water leak is disposed on one side of the cam insertion hole 45. The cam 55 may be inserted into the cam insertion hole 45 through the sealer 57.

The end of the cam 55 and the cam insertion hole 45 are configured to be matched up with each other. The cam 55 is inserted into the cam insertion hole 45 in such a way as not to spin with no traction. In the present embodiment, the end of the cam 55 and the cam insertion hole 45 are formed to have a cross so that they are engaged with each other. The flow channel switching motor 53 may be coupled to a switch 59. The switch 59 controls the driving of the flow channel switching motor 53. The switch 59 is coupled to a control unit. The control unit is coupled to the flowmeter 80.

In the housing 10 according to an embodiment of the present invention, mounting surfaces 20 that are orthogonal to each other are formed so that the discharge ports 17 are protruded and formed under a rim portion 11. At least part of the cap 50 is rounded so that the cap 50 is mounted on the rim portion 11. The inlet port 51 may be formed on the upper side of a portion in which the mounting surfaces 20 are met.

The housing 10 includes the rim portion 11. The rim portion 11 is formed in a circle, and the flow channel switching plate 40 is inserted into the rim portion 11 in such a way as to be rotated. The rim portion 11 is formed on top of the housing 10. The cap 50 is disposed on top of the rim portion 11. The temporary space S for storing water introduced from the inlet port 51 is formed within the rim portion 11. Part of the cap 50 is rounded and may be mounted on the rim portion 11. The inner circumferential surface of the cap 50 may be formed in a cylindrical shape so that it is matched up with the outer circumference surface of the rim portion 11. A plurality of the mounting surfaces 20 is formed. The middle surface 25 may include an approximately flat portion in which the orthogonal mounting surfaces 20 are met. The inlet port 51 may be formed in the middle surface 25. The cap 50 may be disposed on the upper side of the middle surface 25.

The washing machine 100 according to an embodiment of the present invention may include the flowmeter 80 mounted on the inlet port 51 so that the amount of water flowing into the inlet port 51 can be measured.

The flowmeter 80 may include an impeller rotatably provided in a flow path along which water flows. The flowmeter 80 can measure a rate of flow. The flowmeter 80 may be mounted on the inlet port 51. The mounting surfaces may be formed on the left and right sides of the flowmeter 80. The mounting surfaces 20 may be formed at a right angle. The discharge ports 17 are protruded and formed in the mounting surfaces, and the flowmeter 80 is disposed at the edge portions of the mounting surfaces 20. Accordingly, interference between the flowmeter 80 and the discharge port 17 is minimized Preferably, the flowmeter 80 is disposed to face the middle surface 25. The first mounting surface 21 and the fourth mounting surface 24 are disposed on the left and right sides of the flowmeter 80.

The water supply distributor 1 according to an embodiment of the present invention includes the flow channel switching plate 40 of a disk shape in which an open hole 41 is formed; and the housing 10 into which the flow channel switching plate 40 is rotatably inserted and in which a flow channel for communicating the open hole 41 with the discharge ports 17 is formed when the flow channel switching plate 40 is rotated. The water supply distributor 1 includes the flow channel switching plate 40 of a disk shape in which the open hole 41 is formed; and the cap 50 covering the flow channel switching plate 40 so that the temporary space S in which introduced water gathers before it is discharged to the open hole 41 is formed. The housing 10 includes the circular rim portion 11 into which the flow channel switching plate is rotatably inserted; and the flow channel forming plate 15 which is formed within the rim portion 11 and in which a plurality of discharge holes 13 respectively communicating with the plurality of discharge ports 17 is formed so that water is discharged to the different discharge ports 17 when the flow channel switching plate 40 rotates. The pressure limit unit 30 is formed to discharge water gathered in the temporary space S when the flow channel switching plate 40 is disposed so that the open hole 41 does not communicate with the discharge hole 13.

The open hole 41 is formed in the flow channel switching plate 40. When the flow channel switching plate 40 rotates, the open hole 41 also rotates. The flow channel switching plate 40 is inserted into the rim portion 11 in such a way as to rotate. The cam insertion hole 45 is formed in the flow channel switching plate 40 so that the cam 55 is inserted into the cam insertion hole 45. The cam insertion hole 45 may be a hole open in a cross. The flow channel forming plate 15 is disposed under the flow channel switching plate 40. The flow channel forming plate 15 is disposed at the bottom of the rim portion 11 and may be integrated with the rim portion 11. The flow channel forming plate 15 has the plurality of discharge holes 13 formed therein. The discharge holes 13 may be coupled to the different discharge ports 17. The number of discharge holes 13 may be equal to or greater than the number of discharge ports 17. Since the open hole 41 formed in the flow channel switching plate 40 rotates, the discharge holes 13 preferably may be arranged in a circle so that the discharge holes 13 communicate with the open hole 41. The plurality of discharge holes 13 is arranged in a circle at the same interval around the center of rotation O of the flow channel switching plate 40. A discharge flow channel connecting the discharge holes 13 and the discharge ports 17 is formed within the flow channel forming plate 15.

The housing 10 according to an embodiment of the present invention includes the rim portion 11 surrounding the side of the flow channel switching plate 40 and forming the sidewall of the temporary space S; and the flow channel forming plate 15 in which the rim portion 11 stands upright and the plurality of discharge holes 13 is formed so that the flow channel communicates with the open hole 41. The pressure limit unit 30 is formed to discharge water gathered in the temporary space S when the flow channel switching plate 40 is disposed so that the open hole 41 and the discharge holes 13 do not communicate with each other.

The pressure limit unit 30 functions to maintain water pressure within the temporary space S at predetermined pressure or less. Water is introduced into the temporary space S through the inlet port 51. If the open hole 41 does not communicate with at least any one of the discharge holes 13, water pressure within the temporary space S rises because it is not discharged. The pressure limit unit 30 is configured to discharge water gathered in the temporary space S. Preferably, the pressure limit unit 30 operates when the open hole 41 does not communicate with the discharge holes 13.

A plurality of through holes 43 arranged to form a circle around the rotating axis of the flow channel switching plate 40 is formed in the flow channel switching plate 40 according to an embodiment of the present invention. The pressure limit unit 30 may be a space which communicates with the through holes 43 so that water is introduced through the through holes 43 and which is formed under the flow channel switching plate 40.

The through holes 43 are formed in the flow channel switching plate 40. A plurality of the through holes 43 is formed at the same interval around the center of rotation O of the flow channel switching plate 40. The through holes 43 are arranged at the same angle around the center of rotation O. The distance between the through holes 43 and the center of rotation O is shorter than the distance between the open hole 41 and the center of rotation O.

The pressure limit unit 30 may be formed in the housing 10. The pressure limit unit 30 is formed in the flow channel forming plate 15. The pressure limit unit 30 provides a space in which water introduced through the through holes 43 stays. Preferably, the pressure limit unit 30 discharges water, introduced through the through holes 43, to the outside of the water supply distributor 1. More preferably, the pressure limit unit 30 discharges water, introduced through the through holes 43, to any one of the discharge ports 17.

The pressure limit unit 30 according to an embodiment of the present invention is formed in a gear form so that whether it communicates with the temporary space S is different depending on a rotation angle of the flow channel switching plate 40. Furthermore, the pressure limit unit 30 may include inlet spaces 30*a* periodically formed so that the pressure limit unit 30 communicates with the through holes 43 and a water collection space 30*b* formed in a circle so that the inlet spaces 30*a* are interconnected.

The pressure limit unit 30 may be a space formed in the flow channel forming plate 15 in a gear form. The inlet spaces 30*a* and the water collection space 30*b* may be configured in a gear form generally. The cam 55 may be inserted into the center of the water collection space 30*b*. The insertion hole of the cap 50 may be formed in the center of the water collection space 30*b*.

The through holes 43 and the discharge holes 13 according to an embodiment of the present invention may be periodically formed at the same angle around the center of rotation O so that each of the through and discharge holes forms a circle. An angle cycle θ3 formed by the through holes 43 may be the same as an angle cycle θ2 formed by the discharge holes 13.

The pressure limit unit 30 according to an embodiment of the present invention communicates with the discharge holes 13 so that water introduced through the through holes 43 flows into the discharge ports 17. The through holes 43 are formed in the flow channel switching plate 40. An angle cycle θ1 formed by the inlet spaces 30*a* communicating with the through holes 43 may be the same as an angle cycle θ2 formed by the discharge holes 13. The through holes 43 may be formed in the same angle cycle θ3 around the center of rotation O. All the angle cycle θ1 of the inlet spaces 30*a*, the angle cycle θ2 of the discharge holes 13, and the angle cycle θ3 of the through holes 43 may be the same. The inlet spaces 30*a* may communicate with the discharge holes 13.

A plurality of first discharge holes 13*a* which are arranged to form a circle around the center of rotation O of the flow channel switching plate 40 and a second discharge hole 13*b* which is formed closer to the center of rotation O than to the first discharge holes 13*a* and communicates with at least any one of the first discharge holes 13*a* are formed in the discharge holes 13 according to an embodiment of the present invention. The second discharge hole 13*b* is formed between the inlet spaces 30*a* and the first discharge holes 13*a* around the center of rotation O. The inlet spaces 30*a* may communicates with the first discharge holes 13*a* through the second discharge hole 13*b*.

A first open hole 41*a* selectively communicating with at least any one of the first discharge holes 13*a* depending on a rotation angle, a second open hole 41*b* communicating with the second discharge hole 13*b* depending on a rotation angle, and the through holes 43 formed closer to the center of rotation O than to the second open hole 41*b* are formed in the flow channel switching plate 40 according to an embodiment of the present invention. The pressure limit unit 30 may be a space formed within the flow channel forming plate 15 so that the through holes 43 and the second discharge hole 13*b* are coupled when the first discharge holes 13*a* and the second discharge hole 13*b* are closed by the flow channel switching plate 40.

The pressure limit unit 30 communicates with the through holes 43 when the first discharge holes 13*a* do not communicate with the first open hole 41*a* and the second discharge hole 13*b* does not communicate with the second open hole 41*b*.

The angle θ4 formed by the first open hole 41*a* and the second open hole 41*b* around the center of rotation O may be a multiple of the angle θ1 and/or θ2 and/or θ3. For example, assuming that the through holes 43 communicate with the inlet spaces 30*a* when the flow channel switching plate 40 rotates θ1/2, the open hole 41 and the discharge holes 13 have been cut off. Assuming that the through holes 43 and the inlet spaces 30*a* have been cut off when the flow channel switching plate 40 rotates θ1, the open hole 41 communicates with the discharge holes 13.

The washing machine 100 according to an embodiment of the present invention includes the casing 100 forming the exterior of the washing machine 100; the tub 132 disposed within the casing; the drum 134 rotatably provided in the tub and accommodating the laundry; and the water supply distributor 1 disposed within the casing 110 in such a way as to distribute externally introduced water to a plurality of points. The water supply distributor 1 includes the housing 10 in which the pressure limit unit 30 recessed in a gear form and the discharge holes 13 formed in a cycle of a constant angle around the pressure limit unit 30 are formed; and the flow channel switching plate 40 rotatably inserted into the housing 10 and including the plurality of holes 41 and 43 alternately communicating with the pressure limit unit 30 or the discharge holes 13 depending on the degree of rotation.

The plurality of holes includes the open hole 41 communicating with the discharge holes 13 depending on the degree of rotation of the flow channel switching plate 40 and the through holes 43 capable of communicating with the pressure limit unit 30 depending on the degree of rotation of the flow channel switching plate 40. The open hole 41 and the through holes 43 are placed at different distances from the center of rotation of the flow channel switching plate 40. The through holes 43 are formed close to the center of rotation, and the distance between the through holes 43 is narrow. The open hole 41 is disposed at a longer distance from the center of rotation than the through holes 43, and the distance between the open holes is wider than the distance between the through holes 43.

The washing machine according to an embodiment of the present invention includes the drum 134 accommodating fabrics; the tub 132 accommodating the drum; and the water supply distributor 1 including the plurality of discharge ports 17 for supplying externally supplied water to a plurality of target points including the tub 132 and the pressure limit unit 30 for limiting an increase of internal pressure if water is not discharged by any part of the plurality of discharge ports 17. When the water supply distributor 1 operates to supply water to at least any one of a plurality of target points, it communicates the flow channel alternately with at least any one of the plurality of discharge ports 17 and the pressure limit unit 30. The target points may be the detergent box 114 and/or the steam generation device 139 and may be different depending on the specifications of a washing machine.

The washing machine according to an embodiment of the present invention includes the casing 110 forming the exterior of the washing machine; the tub 132 disposed within the casing 110; the drum 134 rotatably provided within the tub 132 and accommodating the laundry; and the water supply distributor 1 disposed within the casing 110 in such a way as to distribute externally introduced water to a plurality of points. The water supply distributor 1 includes the flow channel switching plate 40 of a disk shape in which the plurality of through holes 43 arranged in a circle and the at least one open hole 41 are formed; the cap 50 covering the flow channel switching plate 40 so that the temporary space S in which introduced water is gathered before it is discharged to the open hole 41 or the through holes 43; and the housing 10 into which the flow channel switching plate 40 is rotatably inserted and in which the plurality of discharge holes 13 arranged in a circle so that the open hole 41 communicates with different flow channels depending on a rotation angle of the flow channel switching plate 40 and the pressure limit unit 30 communicating with the through holes 43 depending on a rotation angle of the flow channel switching plate 40 are formed.

Figure 7:
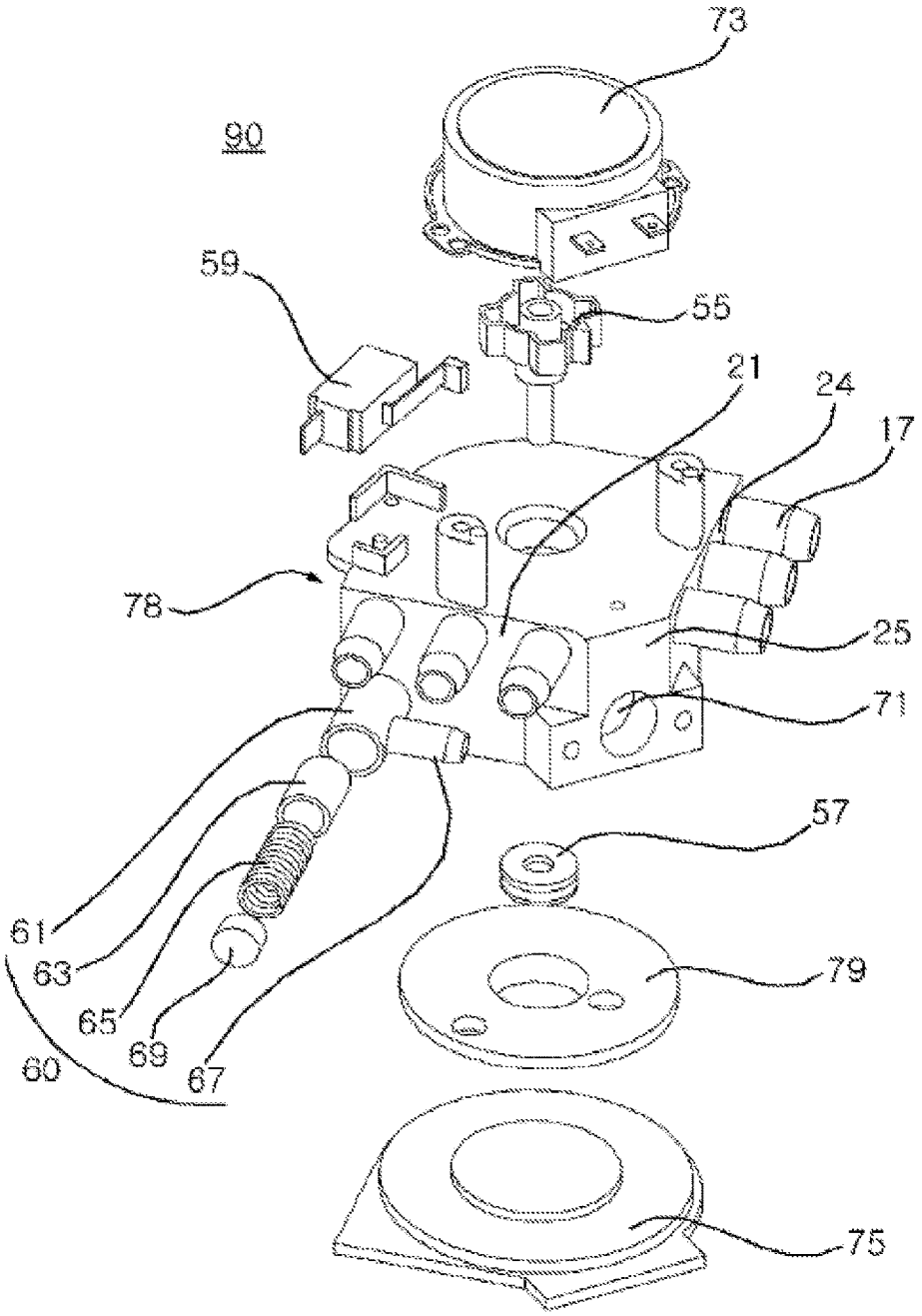
FIG. 7 is an exploded perspective view showing the water supply distributor according to another embodiment of the present invention.
Figure 8:
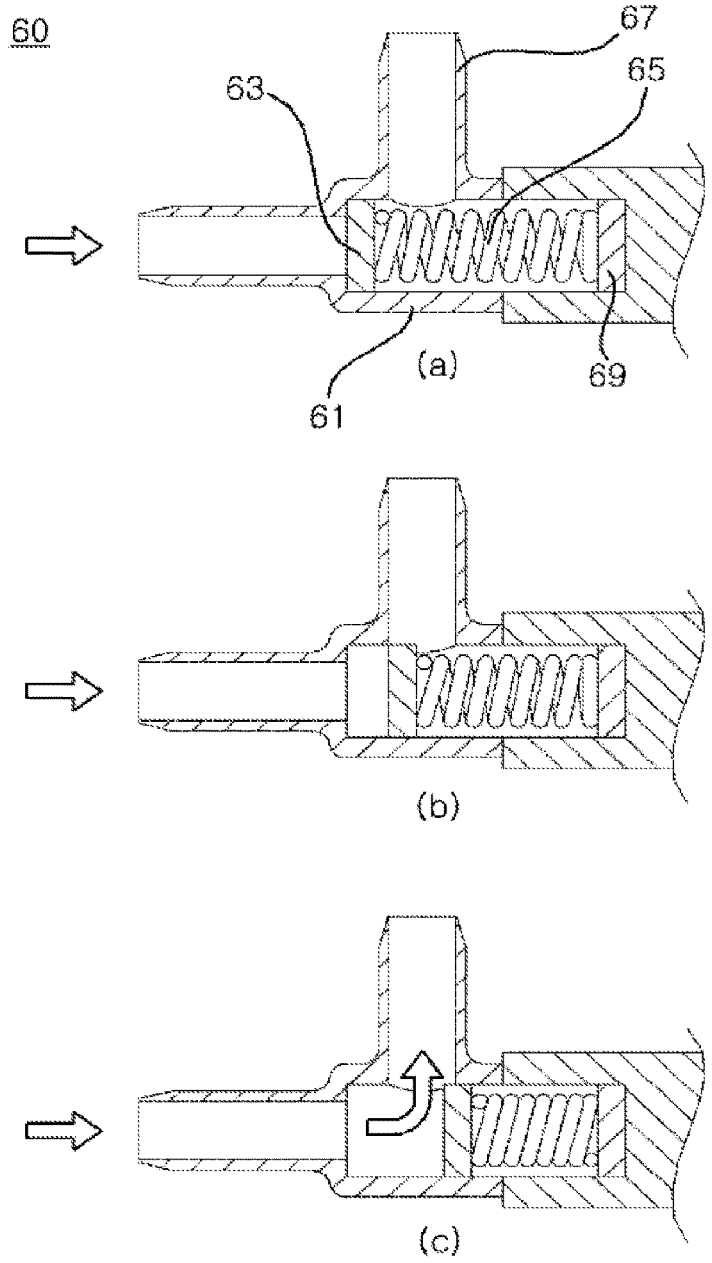
FIG. 8 shows the operation of the pressure limit unit according to another embodiment of the present invention.

FIG. 7 is an exploded perspective view showing the water supply distributor 1 according to another embodiment of the present invention. FIG. 8 shows the operation of the pressure limit unit 30 according to another embodiment of the present invention. In FIGS. 7 and 8, the same reference numerals as those shown in FIGS. 1 to 6 denote the same members. Contents different from the aforementioned embodiment of the present invention are chiefly described below.

Referring to FIGS. 7 and 8, a water supply distributor 90 according to an embodiment of the present invention includes a cap 75 covering a housing 78 so that a temporary space S is formed. The pressure limit unit 60 includes a protruding portion 61 communicating with the temporary space S and lengthily extended to the outside of the housing 78 or the cap 75; a shield plate 63 inserted into the protruding portion 61 in such a way as to shield a flow channel formed within the protruding portion 61; a resilient member 65 disposed between the end of the protruding portion 61 and the shield plate 63; and a pressure release port 67 communicating with the protruding portion 61 so that water is discharged to the outside when the shield plate 63 is moved by water pressure of the temporary space S.

Water from the temporary space S can flow into the protruding portion 61. The pressure limit unit 30 may control the time when water is discharged by controlling elastic modulus of the resilient member 65. The shield plate 63 is inserted into the protruding portion 61 so that water pressure is transferred to the resilient member. Preferably, the shield plate 63 seals the resilient member so that it does not sink under water. Furthermore, the shield plate 63 seals the resilient member so that water is not introduced into the pressure release port 67 through the shield plate 63. The pressure release port 67 is formed on the compression path of the shield plate 63 and/or the resilient member 65. When the resilient member 65 is compressed due to increased water pressure, water introduced into the protruding portion 61 communicates with the pressure release port 67. A support 69 supports the resilient member so that the position of the resilient member 65 is maintained. The support 69 shields the protruding portion 61.

The washing machine 100 according to an embodiment of the present invention includes an inlet port 71 formed in the housing 78 and communicating with the temporary space S so that water is supplied to the water supply distributor 90; and a flow channel switching motor 73 mounted on the housing 77 in such a way as to rotate the flow channel switching plate 79. Furthermore, mounting surfaces 20 orthogonal to each other so that the discharge ports 17 are protruded and formed therein are formed on the side of the housing 77 according to an embodiment of the present invention. The inlet port 51 may be formed in a portion in which the mounting surfaces 20 are met.

The inlet port 71 may be directly formed in the housing 78. The inlet port 71 may be formed in a middle surface 25. The middle surface 25 is formed between a first mounting surface 21 and a fourth mounting surface 24. One side of the middle surface 25 meets the first mounting surface 21, and the other side of the middle surface 25 meets the fourth mounting surface 24. The direction in which the first mounting surface 21 extends may be orthogonal to the direction in which the fourth mounting surface 24 extends.

The operation of the washing machine 100 configured as described according to the present invention is described below.

Water discharged by an external water supply source is introduced into the casing 110. The water is introduced into the water supply distributor 1 through the inlet port 51 via the flowmeter 80. The water is introduced into the temporary space S. The control unit moves the water to the place to which the water needs to be supplied in accordance with a washing cycle. The control unit drives the flow channel switching motor 53, thereby rotating the flow channel switching plate 40. The flow channel switching plate 40 is rotated at a predetermined angle so that the flow channel switching plate 40 communicates with a predetermined discharge hole 13 by the rotation of the open hole 41. The water within the temporary space S is introduced into the discharge holes 13 through the open hole 41. The water introduced into the discharge holes 13 flows into the discharge ports 17 that communicate through the flow channel formed within the flow channel forming plate 15. The discharge ports 17 are coupled to the water supply pipe and coupled to the detergent box 114, the steam device, the spray nozzle, etc.

Meanwhile, the flow channel switching plate 40 may not be rotated at a predetermined angle due to a malfunction of the flow channel switching motor 53. In this case, the communication hole may not be coupled to the discharge holes 13. In this case, in order to reduce water pressure within the temporary space S, the pressure limit unit 30 operates. In an embodiment, the pressure limit unit 30 may be a space recessed in the housing 10 in a gear form. In this case, the water flows into the pressure limit unit 30 through the through holes 43, and the pressure limit unit 30 is coupled to the discharge holes 13. Accordingly, the water may flow into the discharge ports 17.

The pressure limit unit 30 may include the protruding portion 61 communicating with the temporary space S. If water pressure within the temporary space S is a reference value or less, the shield plate 63 has been stopped as shown in FIG. 8(*a*). When water is introduced into the temporary space S and water pressure increases, a force is applied to the resilient member 65 through the shield plate 63 of the protruding portion 61. As water pressure increases, the shield plate 63 moves toward the pressure release port 67. In this case, the shield plate 63 may be moved as shown in FIG. 8(*b*). If the shield plate 63 moves at a predetermined distance or more due to a continuous increase of water pressure, the temporary space S communicates with the pressure release port 67. The water is discharged to the outside of the water supply distributor 1. In this case, the shield plate 63 may move as shown in FIG. 8(*c*).

Although the preferred embodiments of the present invention have been illustrated and described, the present invention is not limited to the aforementioned specific embodiments, and those skilled in the art to which the present invention pertains may modify the present invention in various ways without departing from the gist of the present invention claimed in the claims. The modified embodiments should not be understood individually from the technical spirit or prospect of the present invention.

The invention claimed is:

1. A washing machine, comprising:

a casing forming an exterior;

a tub disposed within the casing;

a drum rotatably provided in the tub, for accommodating laundry; and a water supply distributor disposed within the casing and comprising a temporary space in which externally introduced water gathers, a plurality of discharge ports for distributing the water of the temporary space toward a plurality of points, and a pressure limit unit for limiting an increase of water pressure within the temporary space, wherein the water supply distributor comprises:

a flow channel switching plate of a disk shape in which an open hole and a plurality of through holes arranged to form a circle around a center of rotation are formed; and a housing into which the flow channel switching plate is rotatably inserted and in which a flow channel for communicating the open hole with the discharge ports is formed when the flow channel switching plate is rotated, wherein the housing comprises a rim portion surrounding a side of the flow channel switching plate and forming a sidewall of the temporary space and a flow channel forming plate in which the rim portion stands upright and a plurality of discharge holes is formed so that the flow channel communicates with the open hole, and wherein the pressure limit unit is formed to connect the plurality of through holes when the flow channel switching plate is disposed so that the open hole and the discharge holes do not communicate with each other, wherein the discharge holes comprise:

a plurality of first discharge holes arranged to form a circle around a center of rotation of the flow channel switching plate, and a second discharge hole formed closer to the center of rotation than to the first discharge holes, for communicating with at least any one of the first discharge holes, and wherein the pressure limit unit is formed in the flow channel forming plate to provide a space in which water introduced through the through holes communicates with the at least any one of the first discharge holes through the second discharge hole.

2. The washing machine of claim 1, wherein the pressure limit unit is formed to discharge the water gathered in the temporary space when the flow channel switching plate is disposed so that the open hole and the discharge holes do not communicate with each other.

3. The washing machine of claim 2, wherein the flow channel switching plate comprises a plurality of through holes arranged to form a circle around a center of rotation, and wherein the pressure limit unit comprises a space formed in the housing, for communicating with the through holes so that the water is introduced through the through holes.

4. The washing machine of claim 3, wherein the pressure limit unit is formed in a gear form so that whether the pressure limit unit communicates with the temporary space is different depending on a rotation angle of the flow channel switching plate.

5. The washing machine of claim 4, wherein the pressure limit unit forms inlet spaces periodically formed to communicate with the through holes and a water collection space of a circle so that the inlet spaces are interconnected.

6. The washing machine of claim 3, wherein:

the through holes and the discharge holes are periodically formed at an identical angle around the center of rotation so that each of the through and discharge holes forms a circle, and an angle cycle formed by the through holes is identical with an angle cycle formed by the discharge holes.

7. The washing machine of claim 3, wherein the pressure limit unit communicates with the discharge holes so that the water introduced through the through holes flows into the discharge ports.

8. The washing machine of claim 2, further comprising:

a cap covering the housing in such a way as to form the temporary space;

an inlet port formed in the cap, for communicating with the temporary space so that the water is supplied to the water supply distributor; and a flow channel switching motor disposed on one surface of the cap, for rotating the flow channel switching plate.

9. The washing machine of claim 8, wherein:

the housing comprises mounting surfaces which are formed under the rim portion and which are orthogonal to each other so that the discharge ports are protruded, at least part of the cap is rounded and mounted on the rim portion, and the inlet port is formed over a portion in which the mounting surfaces are met.

10. The washing machine of claim 8, further comprising a flowmeter mounted on the inlet port, for measuring a rate of flow of water flowing into the inlet port.

11. The washing machine of claim 2, further comprising a cap covering the housing to form the temporary space, wherein the pressure limit unit comprises:

a protruding portion communicating with the temporary space and lengthily extended to an outside of the housing or the cap;

a shield plate inserted into the protruding portion in such a way as to shield a flow channel formed within the protruding portion;

a resilient member disposed between an end of the protruding portion and the shield plate; and a pressure release port communicating with the protruding portion so that water is discharged to the outside when the shield plate is moved by the water pressure of the temporary space.

12. The washing machine of claim 2, further comprising:

an inlet port formed in the housing, for communicating with the temporary space so that the water is supplied to the water supply distributor; and a flow channel switching motor mounted on the housing, for rotating the flow channel switching plate.

13. The washing machine of claim 12, wherein:

mounting surfaces orthogonal to each other are formed on a side of the housing so that the discharge ports are protruded, and the inlet port is formed in a portion in which the mounting surfaces are met.

14. The washing machine of claim 2, wherein:

the housing comprises a first mounting surface flatly formed on a side of the housing, a second mounting surface meeting the first mounting surface at a right angle, extended from the first mounting surface, and curved toward a side end portion of the second mounting surface, a third mounting surface meeting the second mounting surface in such a way as to be curved, extended from the second mounting surface, and flatly formed toward a side end portion of the third mounting surface, and a fourth mounting surface meeting the third mounting surface at a right angle, flatly formed, and forming a right angle with the first mounting surface, and the discharge ports are formed in at least two of the first mounting surface, the second mounting surface, the third mounting surface, and the fourth mounting surface.

15. The washing machine of claim 1, wherein:

the flow channel switching plate comprises a first open hole selectively communicating with at least any one of the first discharge holes depending on a rotation angle, a second open hole communicating with the second discharge hole depending on a rotation angle, and through holes formed closer to the center of rotation than to the second open hole, and the pressure limit unit comprises a space formed within the flow channel forming plate so that the through holes and the second discharge hole are coupled when the first discharge holes and the second discharge hole are closed by the flow channel switching plate.

* * * * *